US005314020A

United States Patent [19]

Jennings, Jr. et al.

[11] Patent Number: 5,314,020

[45] Date of Patent: May 24, 1994

[54] TECHNIQUE FOR MAXIMIZING EFFECTIVENESS OF FRACTURING IN MASSIVE INTERVALS

[75] Inventors: Alfred R. Jennings, Jr.; Ibrahim S. Abou-Sayed, both of Plano, Tex.

[73] Assignee: Mobil Oil Corporation, Fairfax, Va.

[21] Appl. No.: 943,645

[22] Filed: Sep. 11, 1992

[51] Int. Cl.[5] ..... E21B 43/26; E21B 43/30

[52] U.S. Cl. ..... 166/281; 166/50; 166/297; 166/308

[58] Field of Search ..... 166/50, 281, 297, 308

[56] References Cited

U.S. PATENT DOCUMENTS

| | | | |
|---|---|---|---|
| 4,194,580 | 3/1980 | Messenger | 166/50 X |
| 4,265,311 | 5/1981 | Ely | 166/271 |
| 4,333,461 | 6/1982 | Muller | 128/284 |
| 4,386,665 | 6/1983 | Dellinger | 175/61 |
| 4,434,848 | 3/1984 | Smith | 166/250 |
| 4,479,541 | 10/1984 | Wang | 166/50 X |
| 4,519,463 | 5/1985 | Schuh | 166/50 X |
| 4,817,719 | 4/1989 | Jennings, Jr. | 166/292 |
| 4,834,181 | 5/1989 | Uhri et al. | 166/281 |
| 4,945,994 | 8/1990 | Stagg | 166/50 X |
| 4,951,751 | 8/1990 | Jennings, Jr. | 166/285 |
| 5,111,881 | 5/1992 | Sooliman et al. | 166/281 X |
| 5,127,457 | 7/1992 | Stewart et al. | 166/50 X |
| 5,207,271 | 5/1993 | Sanchez et al. | 166/50 X |

*Primary Examiner*—George A. Suchfield
*Attorney, Agent, or Firm*—Alexander J. McKillop; George W. Hager, Jr.; Charles A. Malone

[57] ABSTRACT

A process where massive hydraulic fracturing (MHF) is used in combination with a novel horizontal and vertical well drilling scheme. The novel well drilling scheme provides the cost benefits of vertical drilling along with the increased pay zone contact of extended-reach drilling. MHF additionally provides for substantially enhanced reservoir drainage.

6 Claims, 1 Drawing Sheet

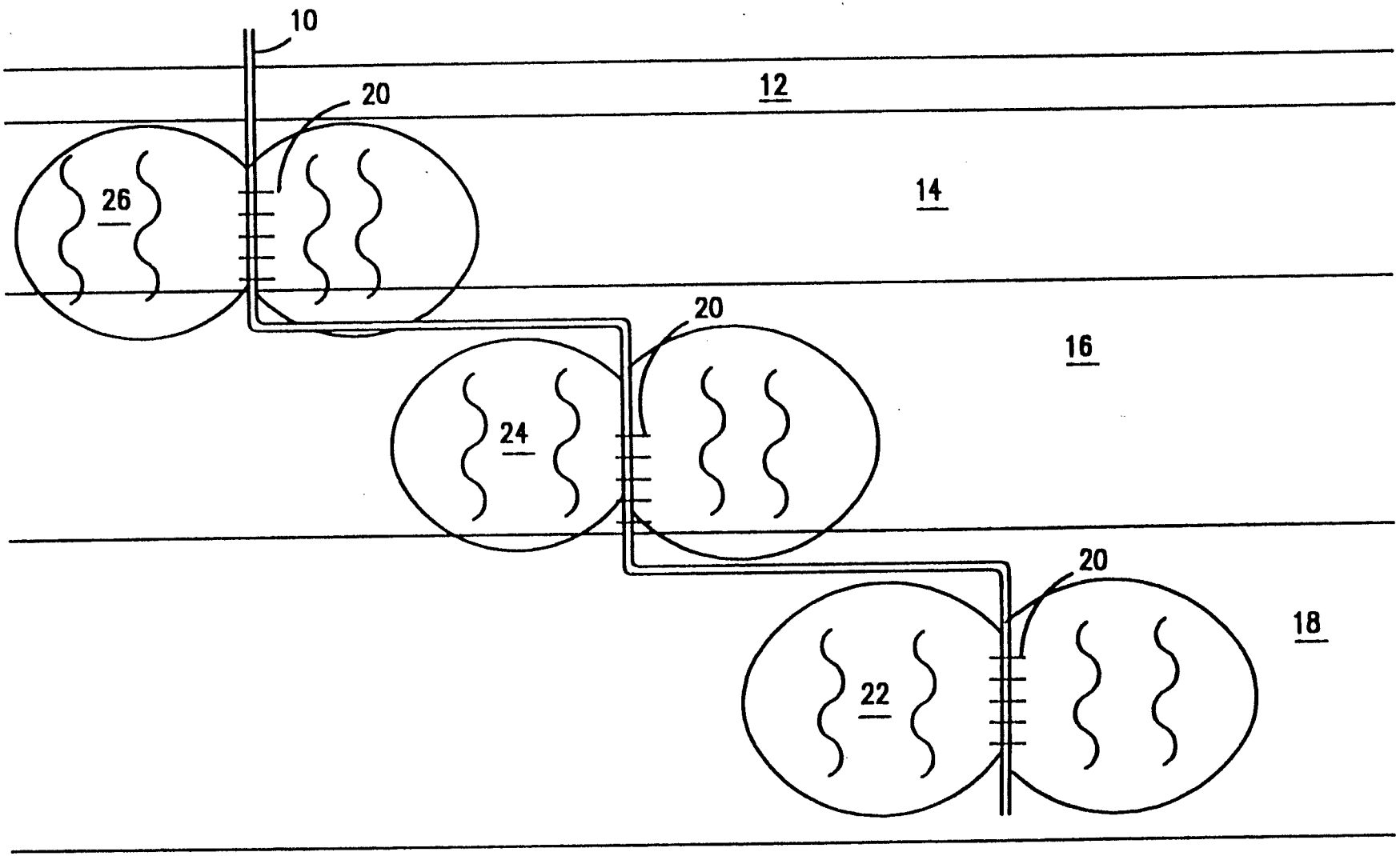
10
12
14
16
18
20
20
20
22
24
26

TECHNIQUE FOR MAXIMIZING EFFECTIVENESS OF FRACTURING IN MASSIVE INTERVALS

FIELD OF THE INVENTION

This invention relates to a method of fracturing subterranean formations surrounding oil wells, gas wells, and similar formations which contain a horizontal wellbore. In one aspect, the invention relates to a method which utilizes massive hydraulic fracturing (MHF) in combination with a solidified gel of a desired density for assisting in the fracturing of intervals along vertical wellbores fluidly connected to horizontal wellbores at different productive intervals.

BACKGROUND OF THE INVENTION

Hydraulic fracturing is a well stimulation technique designed to increase the productivity of a well by creating highly conductive fractures or channels in a producing formation surrounding the well. The process normally involves two basic steps: (1) injecting fluid at a sufficient rate and pressure to rupture the formation, thereby creating a crack (fracture) in the reservoir rock; and (2) thereafter placing a particulate material (propping agent) in the formation to maintain the fracture wall open by resisting forces tending to close the fracture. If stimulation is to occur, the propping agent must have sufficient mechanical strength to bare the closure stresses and provide relatively high permeability in the propped fracture.

With advances in drilling technology, it is currently possible to drill horizontal wellbores deep into hydrocarbon producing reservoirs. Utilization of horizontal wellbores allows extended contact with a producing formation, thereby facilitating drainage and production of the reservoir. In order to enhance the production from a reservoir, it is often necessary to hydraulically fracture the reservoir through which the horizontal wellbore has penetrated.

Although horizontal wellbores allow more contact with the producing formation, some difficulties are encountered when horizontal wellbores are utilized which are not commonly experienced when vertical wells are used. Methods utilized in producing hydrocarbons from a formation or reservoir via vertical wells often prove to be inefficient when attempting to remove hydrocarbons from a reservoir where horizontal wellbores are used. This inefficiency results in utilization of increased amounts of fluids used during enhanced oil recovery operations. This results in a diminution in the amount of hydrocarbons removed from the formation or reservoir.

In order to obtain additional production from a formation penetrated by a horizontal wellbore, it is often necessary to fracture different productive intervals of the formation which might require use of multiple wellbores. To this end, a method for more effectively draining a formation containing laminated massive productive intervals with minimal drilling and well completion expenses would be beneficial.

Jennings, Jr. in U.S. Pat. No. 4,951,751, which issued on Aug. 28, 1990 teaches a method for staging a fracturing treatment in a horizontal wellbore where a solidified gel is used as a diverting medium. However, the fracturing treatment was confined to one productive interval of a formation.

U.S. Pat. No. 4,386,665, that issued to Dellinger on Jun. 7, 1983 teaches a method for providing a wellbore which extends from a surface location and communicates with a mineral-bearing subsurface formation by passing through the formation a plurality of times.

Therefore, what is needed is a method for placement of a wellbore in a formation which wellbore can penetrate vertically different massive laminated productive intervals while extending horizontally substantially further into the formation than previously possible.

SUMMARY OF THE INVENTION

This invention is directed to a method for maximizing the effectiveness of fracturing in a formation which contains at least two laminated massive productive intervals. Initially, a wellbore is drilled into the formation. This wellbore has a first vertical section opened to the surface. It also contains a second spaced apart vertical section which vertical sections communicate with at least one substantially horizontal section therebetween. After drilling the wellbore, the second vertical section, which is furthermost from said first vertical section and which is also deeper in the formation than the first vertical section, is perforated thereby causing it to be in fluid communication with a first laminated massive productive interval. Thereafter, a hydraulic fracturing operation is conducted through perforations in the second vertical section which creates a hydraulic fracture in said first laminated massive productive interval which is located deepest in said formation.

Once the hydraulic fracturing operation is finished in the first interval, a solidifiable liquid mixture is directed into the second vertical section. Here it remains for a time sufficient to form a solid within said fracture and the perforated second vertical section. Subsequently, the first vertical section is perforated. This first vertical section is located in a second laminated massive productive interval above the first interval. A hydraulic fracturing operation is commenced in the first vertical section into the second interval through perforations therein which causes a fracture to form in said second interval. This fracture fluidly communicates with the second perforated interval.

Afterwards, the solid which is formed in the first fracture and the second perforated vertical section is allowed to liquify. After the solid has liquified, fluid communication is established with the wellbore via the first and second laminated productive intervals.

It is therefore an object of this invention to maximize the effectiveness of fracturing in a formation containing laminated productive intervals which are penetrated by a wellbore containing at least two vertical and one horizontal sections.

It is another object of this invention to use a solid to close a created fracture and preclude fluid entry into a second vertical section furthermost from the wellbore opening and thereafter perform a hydraulic fracturing operation in a first higher vertical section which is fluidly connected to said second section by a horizontal section.

It is still yet another object of this invention to provide an economical and cost-effective method for controlling the production of hydrocarbonaceous fluids from a formation by using one wellbore containing at least two vertical and one horizontal sections to obtain a more effective drainage of said formation.

It is a still yet further object of this invention to obtain effective stimulation by fracturing hydraulically through vertical sections of a wellbore which are interconnected with a horizontal section so as to obtain more effective drainage of hydrocarbonaceous fluids from the laminated productive intervals of a formation where more than one wellbore cannot be drilled.

BRIEF DESCRIPTION OF THE DRAWING

The drawing is a schematic representation of a wellbore containing three perforated sections fluidly communicating with two horizontal sections whereupon said vertical sections penetrate different productive intervals of the formation.

DESCRIPTION OF THE PREFERRED EMBODIMENTS

This invention is directed to a technique for providing a wellbore that extends from the earth's surface and communicates with at least two laminated massive mineral-bearing subsurface intervals of a formation. This is accomplished by passing one vertical section of the wellbore through one interval and extending it from the vertical section by a horizontal wellbore. The furthermost end of the horizontal wellbore is fluidly connected to another vertical section which extends through a deeper laminated massive interval of the formation. If desired, another horizontal section can be fluidly connected to the second vertical section's lower end which horizontal section will then extend horizontally out into the formation. By making the perforated vertical sections of the wellbore extend to the lower depths in the formation, productive mineral-bearing intervals of a formation can be fluidly connected with the wellbore. The horizontal section of the wellbore which fluidly communicates with the vertical section allows the wellbore to extend substantially further out into the formation. In this manner, the wellbore's vertical sections can communicate fluidly with multiple productive intervals of a formation where heretofore it would have been impossible to do so without drilling at least two or more vertical wellbores from the surface. This method is particularly applicable where it is not economically possible to drill more than one vertical wellbore into the formation. Additionally, it can also be utilized in those situations where restrictive regulations will not permit more than one vertical wellbore to be drilled in the formation.

This invention is particularly applicable for recovering hydrocarbonaceous fluids from a formation. It is also being described with regard to the recovery of resources from other mineral-bearing formations. A method for directing a deviated wellbore into a hydrocarbonaceous fluid containing formation a plurality of times along a continuous portion of the formation is discussed in U.S. Pat. No. 4,386,665 which issued to Dellinger on Jun. 7, 1983. This patent is hereby incorporated by reference herein.

As discussed above, this invention is directed to a technique for providing vertical sections of a wellbore whereby each vertical perforated section communicates fluidly with a productive interval of the formation. Each subsequent vertical section communicates with a horizontal section and penetrates a deeper massive productive interval of the formation. Additional horizontal and vertical perforated sections are placed in the formation until a desired number of laminated massive productive intervals have been contacted. The wellbore may be completed and cased as desired to provide a well for producing natural resources such as hydrocarbonaceous fluids from all productive intervals of the formation by hydraulic fracturing to achieve greater permeability of said intervals.

In the practice of this invention, referring to the drawing, wellbore 10 is directed into and through overburden 12. The vertical section of wellbore 10 communicates with laminated productive interval 14. This vertical first section fluidly communicates with a horizontal section which extends away from the vertical section by about 1,000 ft. whereupon it turns downwardly to form a subsequent second vertical section in massive laminated productive interval 16. Subsequently, the vertical section forms a second horizontal section which fluidly communicates with said vertical section and extends about 1,000 ft. away from the second perforated vertical section. Thereafter, a second perforated vertical section is directed in a manner so as to form a horizontal section which fluidly communicates with a third perforated vertical section. This third vertical section penetrates deeper into a third massive productive interval 18 and fluidly communicates with the second vertical perforated section by a second horizontal section. This horizontal section is about 1,000 ft. removed from the second perforated vertical section. A method for perforating a wellbore is discussed in U.S. Pat. No. 4,951,751 which issued to Jennings, Jr. on Aug. 28, 1990. This patent is hereby incorporated by reference herein.

Once the wellbore has been placed into the formation to contact as many of the productive intervals as desired, a hydraulic fracturing method is initiated in the vertical section of the wellbore which is furthermost from the surface opening in the vertical wellbore. Methods for conducting hydraulic fracturing in a formation is also disclosed in U.S. Pat. No. 4,951,751. Maximization of the fracture extension during massive hydraulic fracturing is disclosed in U.S. Pat. No. 4,434,848 which issued to Smith on Mar. 6, 1984. This patent is incorporated by reference herein.

Once the fracture has been created to the extent desired in the vertical interval furthermost from the surface opening via perforations 20 so as to form fracture 22, hydraulic fracturing pressure is released. Thereafter, a solidifiable gel containing a gel breaker is injected into wellbore 10 where it enters initially fracture 22 and the vertical portion of the wellbore furthermost removed from the surface opening. The solidifiable gel is allowed to remain in fracture 22 and productive interval 18 for a time sufficient to form a solid gel. It also forms a solid gel within the vertical perforated section of the wellbore which communicates with productive interval 18.

One method of making a suitable, pumpable, solidifiable gel mixture is discussed in U.S. Pat. No. 4,333,461 that issued to Muller on Jun. 8, 1982, and which is incorporated by reference herein. The stability and rigidity of a gel plug which forms in the wellbore's perforated vertical section that communicates with interval 18 will depend on the physical and chemical characteristics of the gel plug. As is known to those skilled in the art, a gel plug should have the stability and rigidity which will withstand pumping forces applied thereto in addition to existing environmental well conditions.

Other gel mixtures can be used to obtain a desired stability and rigidity. A preferred mixture used to obtain the desired stability and rigidity, for example is a mixture of hydropropyl guar cross-linked with transitional metals and ions thereof. The purpose of the transitional metal ions is to provide increased strength, stability and rigidity for the gel plug. A composition of this hydropropyl guar mixture is disclosed in U.S. Pat. No. 4,817,719 which issued to Jennings, Jr. on Apr. 4, 1989 which is incorporated by reference herein. Chemicals suitable for use as gel breakers are also incorporated into the solidifiable gel mixture. These chemical compositions are discussed in U.S. Pat. No. 4,817,719. Other gel breakers sufficient for use for this purpose are discussed in U.S. Pat. No. 4,265,311 which issued to Ely on May 5, 1981. These patents are hereby incorporated by reference herein.

After having formed a solid gel in the furthermost vertical interval from the surface opening of the wellbore, hydraulic fracturing is conducted in interval 16 so as to form fracture 24 via perforations 20. After forming fracture 24 in productive interval 16, a solidifiable gel is directed into fracture 24 and into the vertical portion of the wellbore that fluidly communicates with interval 16 so as to preclude fluid flow therethrough.

Thereafter, the solidifiable gel mixture is allowed sufficient time to form a solid gel. After the solid gel has formed, a fracturing operation is again conducted in the wellbore's vertical portion containing perforations 20 which allow fluid communication with massive productive interval 14. The fracturing operation is conducted via a surface opening in wellbore 10 so as to create fracture 26 via perforations 20 in productive interval 14. Now that all of the desired intervals have been perforated to the extent desired, the solid gel plug is allowed to liquify. Liquification of the gel causes the gel mixture to flow from fractures 24 and fracture 22. Liquified gel is thereafter directed to the surface by hydrocarbonaceous fluids or other natural resources which are produced from massive productive intervals 14, 16 and 18. By positioning the wellbore in this manner and fracturing the formation the desired intervals, fracturing effectiveness in the formation is maximized so as to contact different laminated massive productive intervals of the formation thereby leading to increased production of hydrocarbonaceous fluids or other natural resources therefrom.

Increased hydrocarbonaceous fluid draining can be obtained by perforating the horizontal section of the wellbore. A method for perforating a horizontal section of a wellbore is disclosed in U.S. Pat. No. 4,951,751 which issued to Jennings, Jr. and which has been previously incorporated by reference herein. Although perforations can be made in the horizontal sections of the wellbore either before or after fracturing, for convenience sake it is preferred to perforate the horizontal sections at the same time that the vertical sections are perforated.

Although the present invention has been described with preferred embodiments, it is to be understood that modifications and variations may be resorted to without departing from the spirit and scope of this invention as those skilled in the art will readily understand.

What is claimed is:

1. A method for maximizing the effectiveness of fracturing in a formation containing laminated massive productive intervals comprising:

a) drilling a wellbore into said formation which wellbore has an opening to the surface and contains a first and a second spaced apart vertical sections that communicate with at least one substantially horizontal section;

b) perforating the second vertical section which is furthermost from said opening and deeper in the formation than the first vertical section thereby causing it to be in fluid communication with a first laminated productive interval of said formation;

c) conducting a hydraulic fracturing operation through perforations in said second vertical section thereby creating a hydraulic fracture in said first laminated productive interval which is located deepest in said formation;

d) directing a solidifiable liquid mixture into said second vertical section where it remains for a time sufficient to form a solid within said fracture and perforated vertical section;

e) perforating the first vertical section of said wellbore that is located in a second laminated productive interval above said first interval;

f) fracturing hydraulically into said second interval through perforations in said first section thereby creating a fracture in said second interval which fluidly communicates with the second perforated interval; and g) causing the solid in step d) to liquidfy thereby establishing fluid communication with the wellbore via the first and second laminated productive intervals.

2. The method as recited in claim 1 where after step g) hydrocarbonaceous fluids are produced from the first and second productive intervals.

3. The method as recited in claim 1 where said intervals are fractured by massive hydraulic fracturing.

4. The method as recited in claim 1 where more than two laminated massive productive intervals are contacted by placing additional vertical sections deeper into the formation and additional horizontal sections further into said formation.

5. The method as recited in claim 1 where said first vertical section extends into the formation to a depth of about 300 feet and a horizontal section fluidly communicating therewith extends away from said vertical about 1,000 feet.

6. The method as recited in claim 1 where said first vertical section extends into the formation to a depth of about 300 feet and a horizontal section fluidly communicating therewith extends about 1,000 feet therefrom, a second vertical section fluidly connects with the horizontal section and extends about 300 feet deeper into the formation whereupon another horizontal section extends about 1,000 feet from said second section.

* * * * *